United States Patent [19]

Podell et al.

[11] 4,389,808

[45] Jun. 28, 1983

[54] BOLT-TOGETHER BUILDING SET FOR CHILDREN

[75] Inventors: Jack Podell; Douglas Haner, both of San Francisco, Calif.

[73] Assignee: SB/JP Enterprises, Inc., San Francisco, Calif.

[21] Appl. No.: 268,694

[22] Filed: Jun. 1, 1981

[51] Int. Cl.[3] ..... A63H 33/00

[52] U.S. Cl. ..... 46/16

[58] Field of Search ..... 46/16, 17, 23, 26, 31, 46/24; 52/584

[56] References Cited

U.S. PATENT DOCUMENTS

| | | | |
|---|---|---|---|
| 1,974,838 | 9/1934 | Schmid | 46/16 |
| 2,582,553 | 1/1952 | McMurtrie | 46/26 |
| 3,355,837 | 12/1967 | Pedersen | 46/31 X |
| 3,736,696 | 6/1973 | Laird et al. | 46/22 X |

FOREIGN PATENT DOCUMENTS

| | | | |
|---|---|---|---|
| 2301764 | 7/1974 | Fed. Rep. of Germany | 46/16 |
| 931327 | 2/1948 | France | 46/16 |
| 990651 | 9/1951 | France | 46/16 |
| 562623 | 6/1975 | Switzerland | 46/16 |

*Primary Examiner*—Mickey Yu

*Attorney, Agent, or Firm*—Flehr, Hohbach, Test, Albritton & Herbert

[57] ABSTRACT

A set of building components for children comprising a multiplicity of generally hollow blocks having at least one open face and at least one aperture through each of a plurality of closed faces thereof, and a plurality of nut and bolt fasteners adapted to extend through a pair of aligned apertures in butted block faces to enable fastening of said blocks together in a variety of combinations and configurations. The blocks all have substantially the same cross-sectional configuration and are formed to different lengths corresponding to integer multiples of the length of the shortest block. The apertures in the closed block faces are formed along center lines of the faces with at least some closed block faces on the long sides of the longer blocks having a plurality of apertures therein spaced from each other by integer multiples of one-half of the shortest block length. The set further includes a plurality of flat boards each having a plurality of spaced apertures therethrough to enable fastening of said boards and said blocks together with the nuts and bolts, thereby increasing the variety of structural combinations which can be built.

3 Claims, 3 Drawing Figures

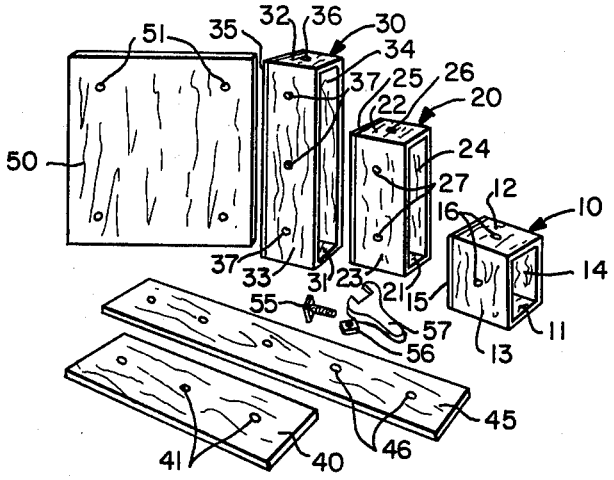
FIG.—1
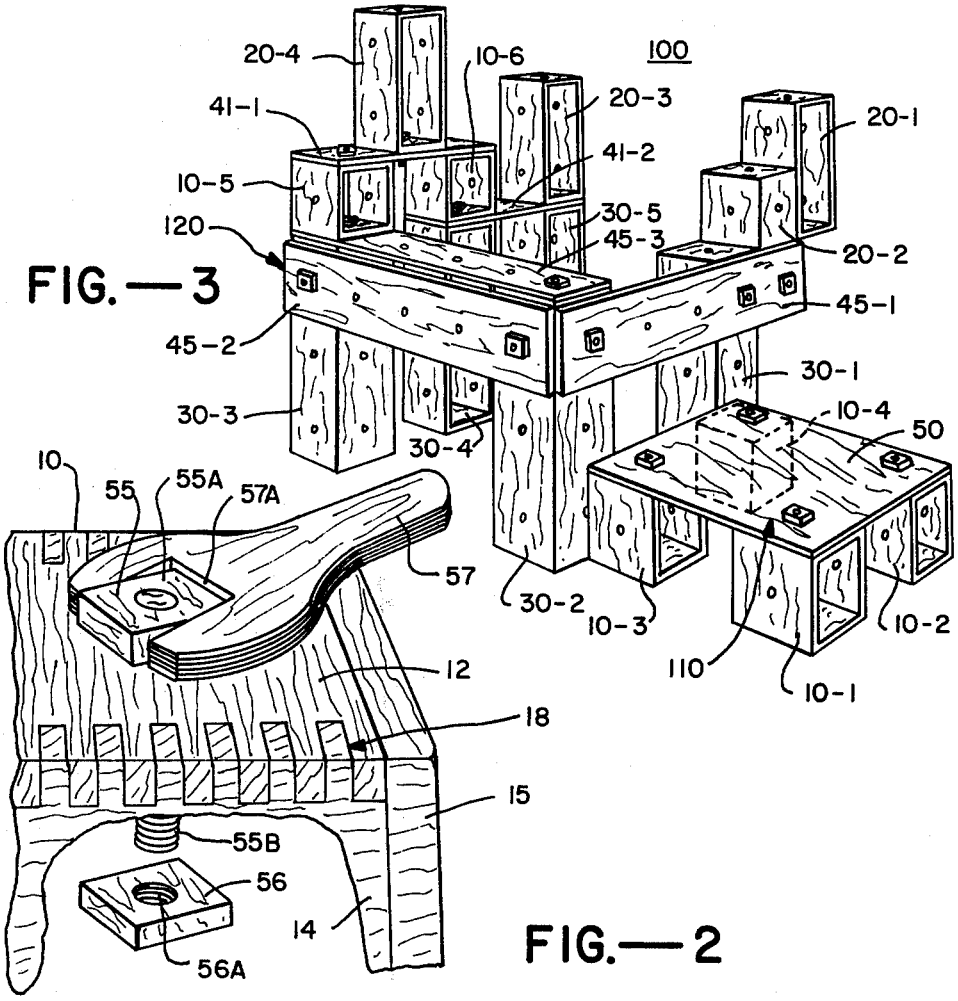
FIG.—3
FIG.—2

BOLT-TOGETHER BUILDING SET FOR CHILDREN

This invention relates generally to childrens' toys and specifically to toys involving the assembly of building components.

There are a wide variety of construction-type toys on the market today. Generally these construction toys fall into two categories: toys whose components positively fasten together and those which simply sit on each other. In the former group are the old standby Erector sets and Tinkertoys together with newer product entries such as "Leggo" blocks. In the latter category are old standbys such as Lincoln Logs and a wide variety of conventional solid or hollow block sets which can be piled on each other to form a structure. The toy construction sets which involve some positive fastening of various components together, such as the Erector sets, Tinkertoys, and "Leggo" blocks, generally permit the fabrication of only model-size building structures and the like, although some giant-size versions of Tinkertoys and slotted board sets are now on the market. In addition, a plastic erector set type of toy called a "Bolt N' Play Building Set" is available on the market and uses a pair of hollow plastic cubes having an array of nine mounting holes on each closed face as foundation elements to which a variety of wheels, struts and other accessories can be bolted. While the two cubes can be bolted together, the building set is not intended for building large and complex structures, but instead small cars, airplanes, tables and the like. While large block sets are available for building more sizeable structures to play in, the types of structures which are achievable with simple block sets are severely limited and the structures can be easily knocked down either purposely or accidentally.

Accordingly, it is a principal object of this invention to provide a set of building components for children which are capable of being fastened together to form a wide variety of building configurations.

It is a further object of this invention to provide a modular set of building components for children which may be simply bolted together into a wide variety of building combinations and configurations and which are large enough to fabricate structures which can be played within and/or upon.

This invention features a set of building components for children comprising a multiplicity of generally hollow blocks having at least one open face and having at least one aperture through each of a plurality of closed faces thereof, and a plurality of fastener means adapted to extend through a pair of aligned apertures in butted block faces to enable fastening of the blocks together in a variety of combinations and configurations. Preferably the blocks are formed such that they all have substantially the same cross-sectional configuration but have different lengths corresponding to integer multiples of the length of the shortest block. In addition the apertures in the closed block faces are preferably formed along center lines of the closed faces with at least some closed block faces on the long sides of the longer blocks having a plurality of apertures therein spaced from each other by integer multiples of one-half of the shortest block length.

A set of building components in accordance with this invention may further comprise a plurality of flat boards, each having a plurality of spaced apertures therethrough to enable fastening of the boards and the blocks together with the fastening means to increase the variety of the structural combinations which can be built. Preferably a plurality of the boards are flat rectangular boards of different lengths corresponding to integer multiples of the length of the shortest block. The set may further comprise boards of other geometric configurations such as a square board having side dimensions which are an integer multiple of the shortest block length.

A preferred embodiment of the invention utilizes blocks of substantially identical, square cross-section with the shortest block being a regular cube having five closed block faces, each with a central fastening aperture therethrough. In this preferred embodiment each of the longer blocks has two closed end block faces with central fastening apertures therethrough and three closed side block faces with a plurality of apertures therethrough at least equal in number to the value of the corresponding integer multiple of the shortest block length represented by that longer block. In such side block faces, the fastening apertures are preferably disposed along the center line of the faces.

A preferred embodiment further comprises a plurality of flat rectangular boards each having a width and length corresponding to an integer multiple of the shortest block length and having fastening apertures therethrough disposed along lines which are spaced from the sides of the boards by an integer multiple of one-half of the block length. The apertures are also spaced from adjacent apertures by an integer multiple of one-half of the shortest block length. Preferably the blocks and boards in the set are formed of wood and each of the fastening means preferably consists of a wooden bolt adapted to extend through the apertures in the boards and blocks and a nut adapted to thread on the bolt. The building set may further comprise a wooden wrench with a head configuration adapted to fit the configuration of the head of the bolt and the nut.

The bolt-together building set of this invention can be fabricated in a wide variety of sizes and shapes, but preferably utilizes components of sufficient size to enable the construction of overall structures which are commensurate with the height of the children using the set. The bolt-together contruction set of this invention has numerous advantages over the standard building block set. The modular block and board sizes together with the modular fastening hole placements permit a wide variety of combinations and configurations of buildings to be assembled. The bolt-fastening feature provides long-term stability in the structure and permits the addition of additional structural features in an evolutionary play experience. The assembly operation utilizing fastening bolts combines a small muscle exercise for the older preschool age child while challenging the ingenuity of the primary grade child to build useful, creative play structures.

Other objects, features, and advantages of this invention will be apparent from a consideration of following detailed description taken in conjunction with the accompanying drawings.

FIG. 1 is a perspective view of a set of building components in accordance with this invention.

FIG. 2 is a fragmented perspective view illustrating structural features of the hollow blocks forming components of a building set in accordance with this invention.

FIG. 3 is a perspective view of an example of an assembled structure utilizing a set of building components in accordance with this invention.

Referring now to FIG. 1, the basic components of a building set in accordance with this invention are illustrated as a plurality of generally hollow blocks 10, 20, and 30. Each of the blocks has one open face and five closed faces. All the different sized blocks 10, 20, and 30, have generally the same square cross-sectional configuration (although other cross-sectional configurations are possible) and the blocks 20 and 30 are formed to lengths which are integer multiples of the length of the shortest block 10. As shown the shortest block 10 is a substantially regular cube. The block 20 is a rectangular block with a length that is two times that of the cube 10. The block 30 is a rectangular block having a length three times that of the cube 10.

Each of the closed faces 11, 12, 13, 14, and 15 of the shortest block 10 has a centrally disposed aperture 16 formed therethrough.

For purposes of regular modularity of construction, it is preferable that each of the apertures 16 is formed with substantial precision at the geometric center of the cube faces. The intermediate length block 20 has a single central aperture 26 in the end faces 21 and 22 thereof and a pair of apertures 27 in each of the longer side faces 23, 24, and 25 of the block. The apertures 27 are formed on the center line of each of the longer block faces and are spaced from each other by a distance equal to the length of the basic cube 10. In addition, the apertures 27 are spaced from the edges of the respective block faces by a distance equal to one-half the length of the basic cube 10. If desired, an additional aperture disposed halfway between the apertures 27 in each closed face of the block 20 could be provided to increase the flexibility of mounting other blocks to the side faces.

Block 30 has two end faces 31 and 32 with centrally disposed fastening apertures 36 formed therein. The longer side faces 33, 34, and 35 of block 30 each have three fastening apertures 37 formed therein with the three apertures separated by a distance equal to the length shortest block 10 and with the apertures spaced from the sides of each face by one-half the length of the shortest block 10. Again, for additional flexibility in mounting of various blocks to the block 30, additional apertures could be formed at intermediate locations between the three apertures shown in FIG. 1.

The block types 10, 20, and 30 may be bolted together in a variety of combinations and configurations using fastening means which are adapted to extend through a pair of aligned apertures when two block faces are butted together. The fastening means may consist for example of a bolt 55 and nut 56. Wrench 57 may be provided to assist in tightening the nut 56 on the bolt 55. By providing a multiplicity of each of the block types 10, 20, and 30, a variety of building structures can be assembled. Block sets may be provided in various sizes of the basic cube 10 with corresponding longer blocks having lengths related to each other by integer multiples of the shortest block. However, it appears that blocks built around a basic modular cube 10 having side dimensions of about seven inches and fashioned from a relatively light wood such as pine result in a block set which can be handled by older preschool children and primary grade children without risking muscle strain. Generally the longer blocks will be utilized on the floor for basic structural elements on which the intermediate and shortest block sizes will be fastened to form the overall structure.

It will, of course, be appreciated that this invention is not limited to the use of different block sizes since many of the features and advantages of the invention can be achieved simply by providing a plurality of cubes which fasten together utilizing a fastening means through apertures in the closed cube faces. Preferably, however, the building components will include at least two or three different block lengths. Depending on the modular size of the smallest block, it may be feasible to utilize blocks of as many as four to six different lengths.

To increase the variety and flexibility of forming various types of building structures, a preferred embodiment of this invention also includes a plurality of flat boards such as boards 40 and 45. Board 40 as depicted in FIG. 1 has a set of three apertures 41 formed therein along the center line of the board and with the apertures spaced from each other by the length of the size of the cube 10. If desired, intermediate apertures separated from the others by one-half the basic cube length could be provided as well. The overall length of the board 40 is three times the length of the sides of the cube 10 and the width of the board 40 is preferably equal to the length of the sides of the cube 10.

The flat board 45 has five fastening apertures formed therethrough along the center line of the board, each of the apertures being spaced from each other by a distance equal to the side length of the cube 10. The board 45 is of length five times the length of the sides of cube 10 and also has a width equal to the length of the sides of cube 10. Generally, the boards which would be most useful with the set of blocks will have lengths which are an integer multiple of the shortest block length. Thus, it will be appreciated that flat boards of lengths in the range of two to six times the basic cube length will be most suitable for incorporating with the blocks to enable a greater variety of structural combinations to be built with the set.

The bolts 55 are preferably formed with a bolt stem having a length sufficient to extend through the thickness of three boards with sufficient threads extending beyond the three boards to hold the nut 56 securely. This enables a block-board-block interface to be assembled with a single bolt and nut combination by aligning two block apertures and a single board aperture, extending the bolt through the aligned apertures and then fastening the nut thereto.

To further increase the variety of structures which can be formed, flat boards of other geometric shapes, such as the square board 50 depicted in FIG. 1, may also be provided with the building component set of this invention. The square board 50 has sides which are three times the length of the basic cube 10 and four apertures 51 are provided therethrough spaced from each other by twice the length of the basic cube 10. It will be appreciated that other fastening apertures could also be provided in the square board 50 to increase the variety of locations at which other components of the set could be attached. It will also be appreciated that other geometric shapes of flat boards could be provided as part of the set and numerous other accessories could be included in the set to increase the interest of and challenge to the child in fashioning structures.

FIG. 2 illustrates a preferred construction of the blocks used in this invention. As shown, interlocking box joints 18 are utilized at the corners of the four side faces of each block and a backboard 15 is fastened to the ends of the four sides. The interlocking box joints provide the blocks with increased durability for long playing life. The backboard 15 may be attached to the four sides utilizing a straightforward glue process or by utilizing a glue and dowel construction for additional strength. All of the blocks and boards are preferably smoothly finished with rounded edges and corners and all surfaces are preferably coated with a water-resistant finish. The nut and bolt combination 55, 56 is preferably formed of a hard wood for additional strength. FIG. 2 illustrates how the bolt and nut fastener may be utilized by inserting the threaded stud 55*b* of the bolt 55 through a fastening aperture in block 10 (and through either another flat board or another block) whereupon the nut 56 having a threaded aperture 56*a* therein may be threaded onto the stud 55*b*. The wrench 57 having a square open head 57*a* may be utilized with the square head 55*a* on the nut 55 or the square nut 56 to assist in tightening the nut and bolt arrangement.

It will be appreciated that other types of block constructions and other types of block materials could be utilized in accordance with this invention. For example the blocks and the flat boards could be molded out of high strength plastic or a molded particle board with or without a Veneer finish. In addition, other types of fastening means could be employed such as a stud with a snap-on cap or any other type of removeable fastening elements.

FIG. 3 illustrates one structure which may be fashioned utilizing the set of building components in accordance with this invention. The structure 100 includes a basic table- or platform-like arrangement 110 together with a three-sided enclosure or building 120. The table or platform 110 is formed with four cubes 10-1 through 10-4 together with the square board 50. The square board 50 is securely fastened to the four cubes using four bolt and nut sets as shown.

The building structure 120 is formed using five of the largest blocks 30-1 through 30-5 as the basic foundational elements. As shown three of the longer boards 45-1 through 45-3 are utilized to tie the largest blocks 30-1, 30-2, and 30-3 together. The large blocks 30-4 and 30-5 are held together with a small board 41-2.

Without going into all of the details of the exemplary structure depicted in FIG. 3, it should be apparent that a wide variety of structures can be assembled utilizing the components of this invention and the structures may vary from very simple structures to quite complex structures involving a variety of approaches to building individual multicomponent modules fastened together utilizing the flat board components provided with the system.

The building components of this invention can be utilized either in a structured learning/play situation or in a free individual or group creativity play environment. The former approach might utilize a set of optional building plans with the challenge being presented to the child to reproduce the building according to plan. In the free creativity environment the child can be simply presented with the elements of the building system and a brief explanation of how the components go together and what are the safe approaches to assembling the components and then given free rein to exercise individual imagination in producing a resulting structure. A system of this invention also offers the opportunity for creative team interaction and cooperation in forming an overall structure.

While the building components of this invention have been described above in connection with a preferred embodiment and various alternatives, it should be apparent that numerous other modifications and additions could be made without departing from the scope of this invention as claimed in the following claims.

What is claimed is:

1. A set of building components for children comprising a multiplicity of hollow blocks having one open face and five closed faces and being formed to different lengths corresponding to integer multiples of the length of the shortest block with the open face of each block being along the longest dimension thereof, each of said blocks having the same cross-sectional configuration transverse to said open face thereof, each of said closed block faces having at least one aperture therein formed along the center line of said face with longer faces on said longer blocks having a plurality of apertures therein spaced from each other by integer multiples of one-half the shortest block length, and a plurality of nut and bolt fasteners with said bolts having a length sufficient to extend through at least a pair of aligned apertures in block faces butted together to enable rigid fastening of said blocks together in a variety of structural combinations and configurations; said shortest block being a regular cube; and said set further comprising a plurality of flat boards of different lengths, each of said boards having a width substantially equal to the length of said cube, a length corresponding to an integer multiple of the length of said cube, and a plurality of apertures formed along a centerline thereof and spaced from each other by an integer multiple of one-half the cube length.

2. A set of building components as claimed in claim 1, further comprising at least one square board having side dimensions which are an integer multiple of said cube length and having a plurality of apertures therein spaced from each other by an integer multiple of said cube length.

3. A set of building components as claimed in any of claims 1 or 2, wherein said blocks are formed from a lightweight wood material and said shortest block is at least about seven inches in length to enable play structures of substantial size to be assembled therefrom.

* * * * *